US005996157A

United States Patent [19]

Smith et al.

[11] Patent Number: 5,996,157

[45] Date of Patent: Dec. 7, 1999

[54] TOOTHBRUSH WITH MANUAL ROTARY PATTERNED BRISTLE METHOD

[76] Inventors: Lee Y. Smith; Paul A. Smith, both of 2311 Mohawk La., Glenview, Ill. 60025

[21] Appl. No.: 09/039,513

[22] Filed: Mar. 16, 1998

[51] Int. Cl.[6] ..... A46B 13/00

[52] U.S. Cl. ..... 15/28; 15/22.1; 15/167.1; 15/DIG. 5

[58] Field of Search ..... 15/22.1, 28, 167.1, 15/DIG. 5, 201

[56] References Cited

U.S. PATENT DOCUMENTS

| | | | |
|---|---|---|---|
| 1,090,126 | 3/1914 | Reichmann | 15/28 |
| 1,557,244 | 10/1925 | Domingue | 15/28 |
| 1,620,330 | 3/1927 | Douglass | 15/28 |
| 3,129,449 | 4/1964 | Cyzer | 15/28 |
| 4,739,532 | 4/1988 | Behrend | 15/28 |
| 5,142,724 | 9/1992 | Park | 15/28 |
| 5,276,932 | 1/1994 | Byrd | 15/28 |
| 5,524,319 | 6/1996 | Avidor | 15/201 |

FOREIGN PATENT DOCUMENTS 2622089 4/1989 France .

*Primary Examiner*—Robert J. Warden, Sr.
*Assistant Examiner*—Kaj K. Olsen
*Attorney, Agent, or Firm*—Patents & TMS, P.C.; Brian M. Mattson

[57] ABSTRACT

A hand held toothbrush with multiple levels of bristles on a rotary pad. When the user manually pushes the brush, there is a force created which propels the bristles to catch the irregular surface of the teeth, gaps, and pockets, causing the rotary pad to turn. The bristle's pattern is designed specially to improve the rotary pad to circular more effectively. The advantage of this invention is that even though the user operates the toothbrush in left and right movement, the bristles on rotary pad, converts left and right motion into circular motion.

5 Claims, 3 Drawing Sheets

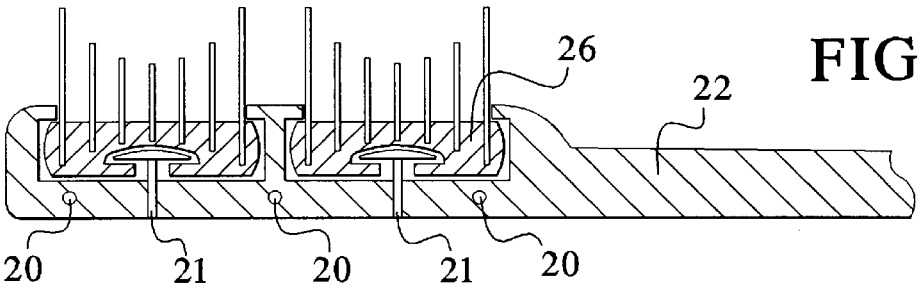
FIG.5
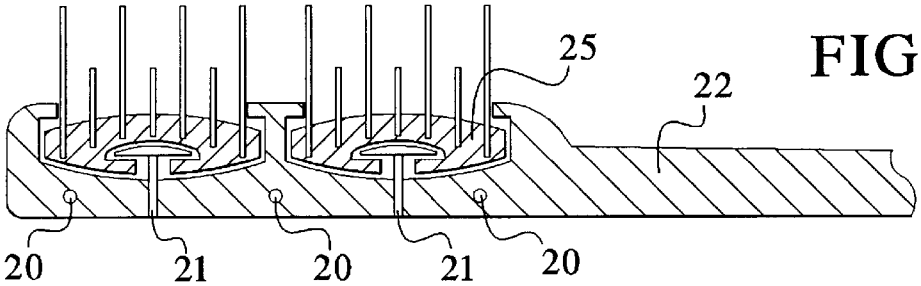
FIG.6
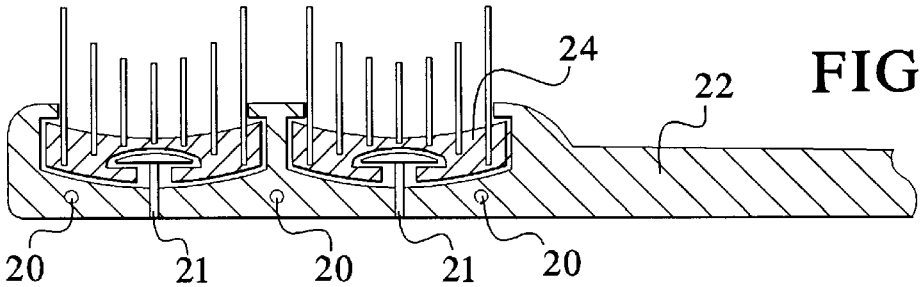
FIG.7
FIG.8
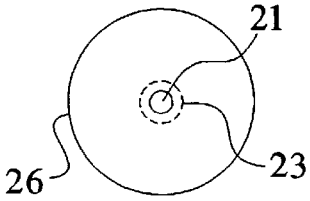

TOOTHBRUSH WITH MANUAL ROTARY PATTERNED BRISTLE METHOD

BACKGROUND OF THE INVENTION

The present invention generally relates to a toothbrush with multiple levels of bristles affixed perpendicular on a rotary pad. When user manually operates forward and backward brush movement that converts the bristles forward and backward motion into circular motion. More specifically the present invention relates to a toothbrush with varying lengths and positioned bristles permanently affixed perpendicular on a rounded pad, which rotates when handle of the brush is pushed either to the right or left manually.

It is generally accepted in dental health care maintenance that circular brushing motion around and along the irregular contours of tooth surfaces is the preferred and correct method of brushing teeth and stimulating gums. The circular brushing motion is the best way to clean the gaps and pockets between teeth. It is also generally known that most people find it difficult to brush their teeth in a sustained circular movement manually, because of the physical effort in maintaining the circular movement for an extended length of time. There are electric toothbrushes that accomplish to some extent of this desired result, however they are costly to the consumer and require the use of electricity or batteries. A need therefore exists for an improved inexpensive toothbrush that converts bristles from forward and backward brushing motion into a desirable system of circular brushing motion manually, to clean and stimulate both teeth and gums in the more dental prescribed manner.

BRIEF SUMMARY OF THE INVENTION

The present invention provides a toothbrush with multiple levels of bristles on a rotary pad. A stepped pattern of bristles is created to brush any and all irregularities, gaps, pockets, and contours in the natural tooth formation and construction. It is the combination of the movement of brushing, and the multiple levels of bristles, that catch the surface of irregular teeth, gaps, and pockets, which propel the bristles to rotate effectively along the teeth and gum line. When user operates left and right brushing movement, there is a force created which propels the bristles to catch the irregular surfaces of the teeth, causing the rotary pad to turn. When user pushes the brush to the left, the rotary pad turns counterclockwise. When user pushes the brush to the right, the rotary pad turns clockwise. The rotary pad can be turned at any desired circular position, depending on whether user normally brushes softer or harder in force. The pattern design and length of bristles can be varied, as long as the result can be accomplished and improved to provide the most effective manually operated rotary brushing method. The toothbrush can be comprised of two or even three rotary pads for an adult size toothbrush, or only one rotary pad for a child's size toothbrush.

BRIEF DESCRIPTION OF THE DRAWINGS

FIG. 5 illustrates a hand held toothbrush with handle and two flat surface rotary pads and water release holes. There is also illustrated two rounded post axis with crown top.

FIG. 6 illustrates a hand held toothbrush with handle and two convex surface rotary pads and water release holes. There is also pictured two rounded post axis with crown top.

FIG. 7 illustrates a hand held toothbrush comprising a handle and two concave rotary pads and water release holes. There is also pictured two rounded post axis with crown top.

FIG. 8 illustrates a rotary pad and rounded post axis with crown top.

DETAILED DESCRIPTION OF THE INVENTION

Figure 1:
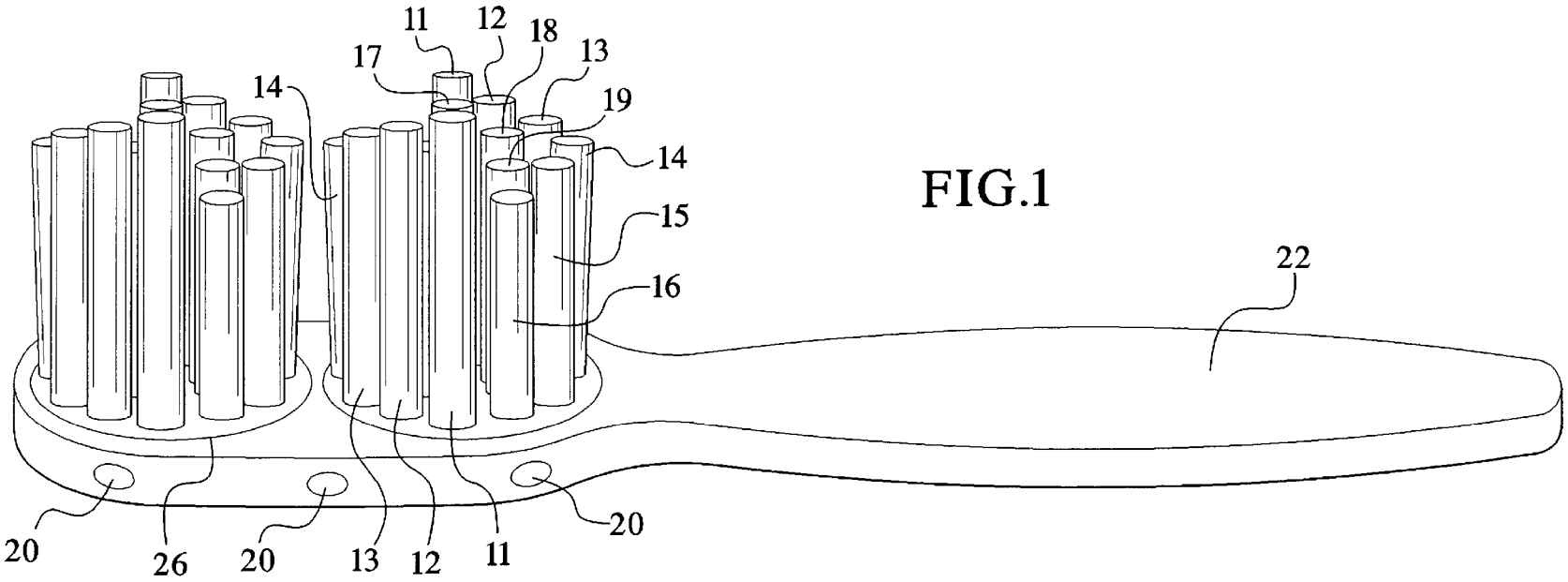
FIG. 1 illustrates a perspective view of a toothbrush, with two rotary pads with varying length bristles, and water release holes.

Referring to drawing FIG. 1 is a hand held toothbrush comprising a handle 22, and two rotary pads 26 with two stepped pattern bristle configurations. Bristle 11 represents highest level graduated to bristles 16, which represents lowest level. The differences in length between bristles 11–16 in graduated outer pattern 11, 12, 13, 14, 15, 16 is 0.04 inch. Bristle 17, 18, 19 which represents inner pattern is shorter in measurement. The difference in length in graduated inner pattern between bristles 17, 18, 19 is 0.04 inch. Water release hole 20 is to release water and toothpaste residue. Hole 20 facilitates clean out. Rotary pad 26 rotates easily upon manually push movement either from right to left or left to right. Rotary motion covers complete 360 degrees or can be rotated at any circular position.

Figure 2A:
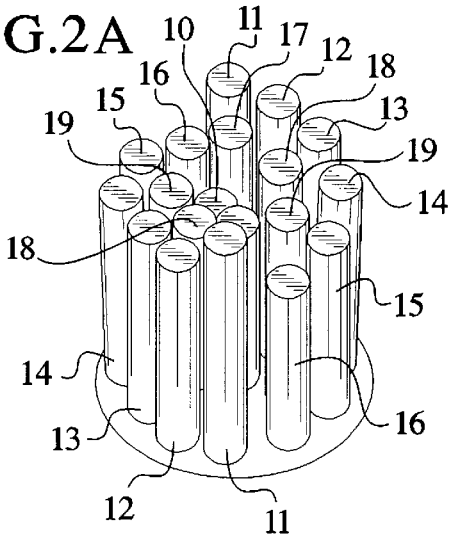
FIGS. 2A and 2B illustrate a perspective views of two different angles of the same bristle pattern. The pattern is two combined sets of equally graduated bristle stepped patterns.
Figure 2B:
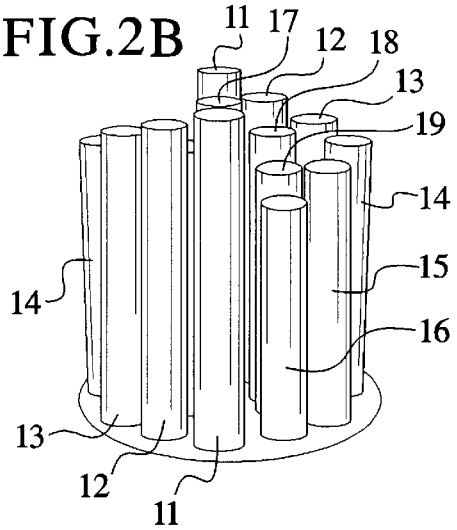

Referring to FIGS. 2A and 2B, bristle pattern exactly same configuration, except graphically displayed from different angle position.

Figure 3A:
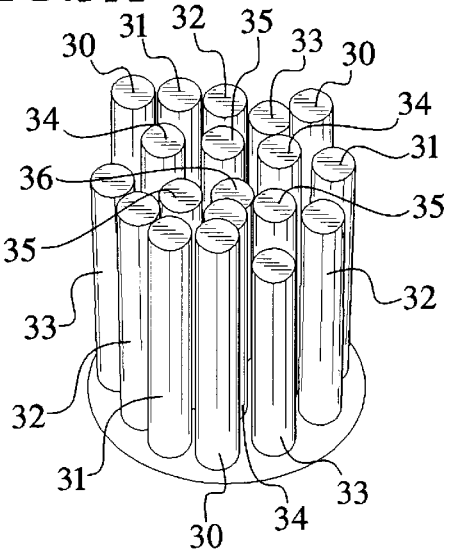
FIGS. 3A and 3B illustrate perspective views of two different angles of the same bristle pattern. The pattern is three combined sets of equally graduated bristle stepped patterns.
Figure 3B:
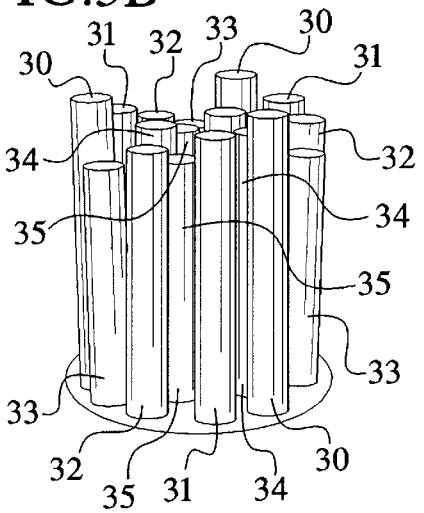

The bristle pattern is designed to specially improve the rotation more effectively. It can be described as follows: center bristle 10 length 0.32 inch. Inner circle consists of two sets of bristles 17, 18, and 19. Bristle 17 is 0.44 inch length. Bristle 18 is 0.4 inch. Bristle 19 is 0.36 inch and the difference in length is 0.04 inch between each bristle 17 to 19. Outer circle consists of two sets of bristles 11, 12, 13, 14, 15, and 16. Bristle 11 is 0.5 inch. Bristle 12 is 0.46 inch. Bristle 13 is 0.42 inch. Bristle 14 is 0.38 inch. Bristle 15 is 0.34 inch. Bristle 16 is 0.3 inch and the difference in length is 0.04 inch between each bristle 11 to 16. Measurement can be adjusted respectively as long as bristles remain consistent with the aforementioned pattern FIGS. 3A and 3B generally illustrate a bristle pattern with exactly same configuration, except graphically displayed from different angle positions. The bristle pattern is designed to specially improve the rotation more effectively. It can be described as follows: center bristle 36 is 0.34 inch length, inner circle consists of three sets of bristles 34 and 35. Bristle 34 is 0.42 inch and bristle 35 is 0.38 inch. Outer circle consists of three sets of bristles 30, 31, 32, and, 33. Bristle 30 is 0.48 inch, bristle 31 is 0.44 inch, bristle 32 is 0.4 inch, and bristle 33 is 0.36 inch. Measurement can be adjusted respectively as long as bristles remain consistent and the aforementioned pattern.

Figure 4A:
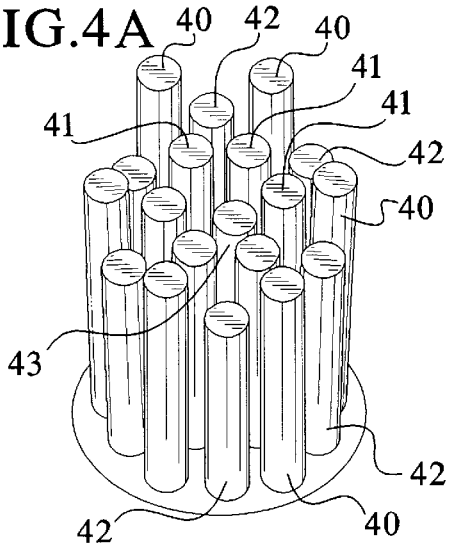
FIGS. 4A and 4B illustrate perspective views of two different angles of bristle patterns. The bristles are in alternating pattern.
Figure 4B:
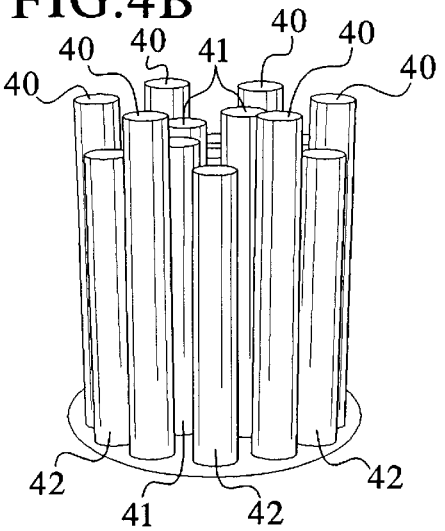

As shown in FIGS. 4A and 4B bristle patterns have exactly same configuration, except graphically displayed from different angle position. The bristle pattern is designed to specially improve the rotation more effectively. It can be described as follows: the center bristle 43 is 0.4 inch, the inner circle consists of six bristles 41, and each bristle 41 is the same length 0.44 inch. Outer circle consists of six bristles 40 and six bristles 42, each bristle 40 length is 0.48 inch, each bristle 42 length 0.4 inch, bristle 40 and bristle 42 are arranged in an alternating pattern. Measurement can be adjusted or respectively as long as bristles remain consistent with the aforementioned pattern.

Referring now to FIG. 5, a hand held toothbrush comprising a handle 22 and brush head with rotary pad 26 with flat surface and multiple levels of bristles, placed on a rounded post axis 21 to allow rotary pad 26 to freely turn. Water release hole 20 on both sides of the brush, is created to facilitate cleaning toothbrush and release excess water.

As shown in FIG. 6, a hand held toothbrush comprising a handle 22 and brush head with rotary pads 25 with a slightly convex top and bottom, with multiple levels of bristles. Placed on rounded post axis 21, the slightly convex shape of the rotary pad is designed to more effectively cause rotary pad to freely turn. Water release hole 20 on both sides of the brush, is created to facilitate cleaning toothbrush and release excess water.

Referring to FIG. 7, a hand held toothbrush comprising a handle 22 and brush head with rotary pads 24 with a slightly concave top and bottom, with multiple levels of bristles. Placed on rounded post axis 21, the slightly concave shape of the rotary pad is designed to more effectively cause rotary pad to freely turn. Water release hole 20 on both sides of the brush, is created to facilitate cleaning toothbrush and release excess water.

FIG. 8 illustrates an axis 21 with wider diameter crown 23, which secures rotary pad 26 in place, and allows rotary pad to turn freely.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A manual toothbrush comprising:

a handle and a bristle containing head with the handle orientation forming a toothbrush plane wherein the bristle containing head has at least one tuft of bristles wherein each tuft of bristles is mounted onto a separate pad such that there is only one pad for each tuft of bristles wherein each pad is mounted to the toothbrush via a post which is perpendicular to the toothbrush plane wherein each post is configured to allow each pad to rotate about an axis which is perpendicular to the toothbrush plane and to allow each pad to rotate freely and independently of rotation of any other pad wherein the tuft of bristles is circular in shape and has a center bristle, an inner circle of bristles which surrounds the center bristle and an outer circle of bristles which surrounds the inner circle of bristles wherein the inner circle bristles all have lengths which differ from the length of the center bristle and the outer circle of bristles has at least two different lengths of bristles, all of which differ in length from the length of the inner circle of bristles and are arranged around the inner circle bristles in a pattern where a set of outer circle bristle lengths goes from longest to shortest before repeating thereby creating a circular stepped tuft that upon moving the toothbrush handle laterally creates a circular rotation of the tufts of bristles.

2. The toothbrush according to claim 1 wherein the toothbrush has fluid release holes on the base of the toothbrush.

3. The toothbrush according to claim 1 wherein the top and bottom of each pad has a convex shaped surface.

4. The toothbrush according to claim 1 wherein the top of each pad has a concave shaped surface and the bottom of each pad has a convex shaped surface.

5. The toothbrush according to claim 1 wherein the top or bottom of each pad has a flat surface.

* * * * *